United States Patent [19]

Beck

[11] 4,054,411

[45] Oct. 18, 1977

[54] HIGH TEMPERATURE FURNACE DOOR SEAL

[75] Inventor: Jacob Howard Beck, Waban, Mass.

[73] Assignee: BTU Engineering Corporation, North Billerica, Mass.

[21] Appl. No.: 698,739

[22] Filed: June 22, 1976

[51] Int. Cl.[2] ..... F27D 1/18

[52] U.S. Cl. ..... 432/242; 34/242; 126/198; 49/477; 110/173 R; 266/271

[58] Field of Search ..... 432/242, 244, 64, 115, 432/56; 126/190, 198; 34/242; 98/36; 110/173 R, 175 R, 182; 266/271, 272; 49/477, 485

[56] References Cited

U.S. PATENT DOCUMENTS

| | | | |
|---|---|---|---|
| 2,124,573 | 7/1938 | Hayes | 432/64 |
| 2,125,517 | 8/1938 | Nicol | 110/175 R |
| 2,641,209 | 6/1953 | Lowe | 110/173 R |
| 2,916,535 | 12/1959 | Marden et al. | 432/64 |
| 3,124,852 | 3/1964 | Holderer | 49/477 |

*Primary Examiner*—John J. Camby
*Assistant Examiner*—Henry C. Yuen
*Attorney, Agent, or Firm*—Weingarten, Maxham & Schurgin

[57] ABSTRACT

A door seal especially adapted to for use in a high temperature furnace wherein a sealing gas is controllably introduced between confronting surfaces of the door and the furnace to establish a gas barrier against leakage of cover gas from within the furnace chamber and leakage of air into the furnace chamber.

7 Claims, 2 Drawing Figures

HIGH TEMPERATURE FURNACE DOOR SEAL

FIELD OF THE INVENTION

This invention relates to high temperature furnaces for the heat processing of products and materials and more particularly to a furnace door seal therefor.

BACKGROUND OF THE INVENTION

In the heat processing of products and materials it is often required to maintain in a furnace chamber a predetermined gas environment which may be of critical composition, such as $CO_2$ or CO in equilibrium, or which may be dangerous. Leakage of gas from the furnace chamber can affect the intended furnace environment and can release dangerous gas outside of the furnace with possibly serious consequences. Leakage of air into the furnace can also have deleterious and possibly hazardous effects. Gas leakage from the furnace as well as air leakage into the furnace usually occur around the door by which the furnace is loaded and unloaded. The requirements for an efficient furnace door seal have been incompatible with the requirements for easy access to the furnace for loading and unloading purposes.

SUMMARY OF THE INVENTION

Briefly, the present invention provides a door seal especially adapted for use in a high temperature furnace wherein a sealing gas is controllably introduced between confronting surfaces of the door and the furnace for flow therebetween to provide a barrier against leakage of the gas environment maintained within the furnace chamber and leakage of air into the furnace chamber. In typical implementation the furnace door is slidably disposed at an end of the furnace chamber, with mating surfaces of the door and furnace being machined or otherwise processed to provide smooth intimate contact. A gas orifice is provided in at least one of the mating surfaces and from which a neutral or non-reactive sealing gas is caused to flow between the mating surfaces to the furnace chamber and to the exterior thereby establishing a gas curtain providing a barrier against leakage of gas into or out of the furnace chamber. The invention also finds application in environmental chambers in which a controlled gas environment is to be maintained.

DESCRIPTION OF THE DRAWINGS

The invention will be more fully understood from the following detailed description taken in conjunction with the accompanying drawing in which.

DETAILED DESCRIPTION OF THE INVENTION

Figure 1:
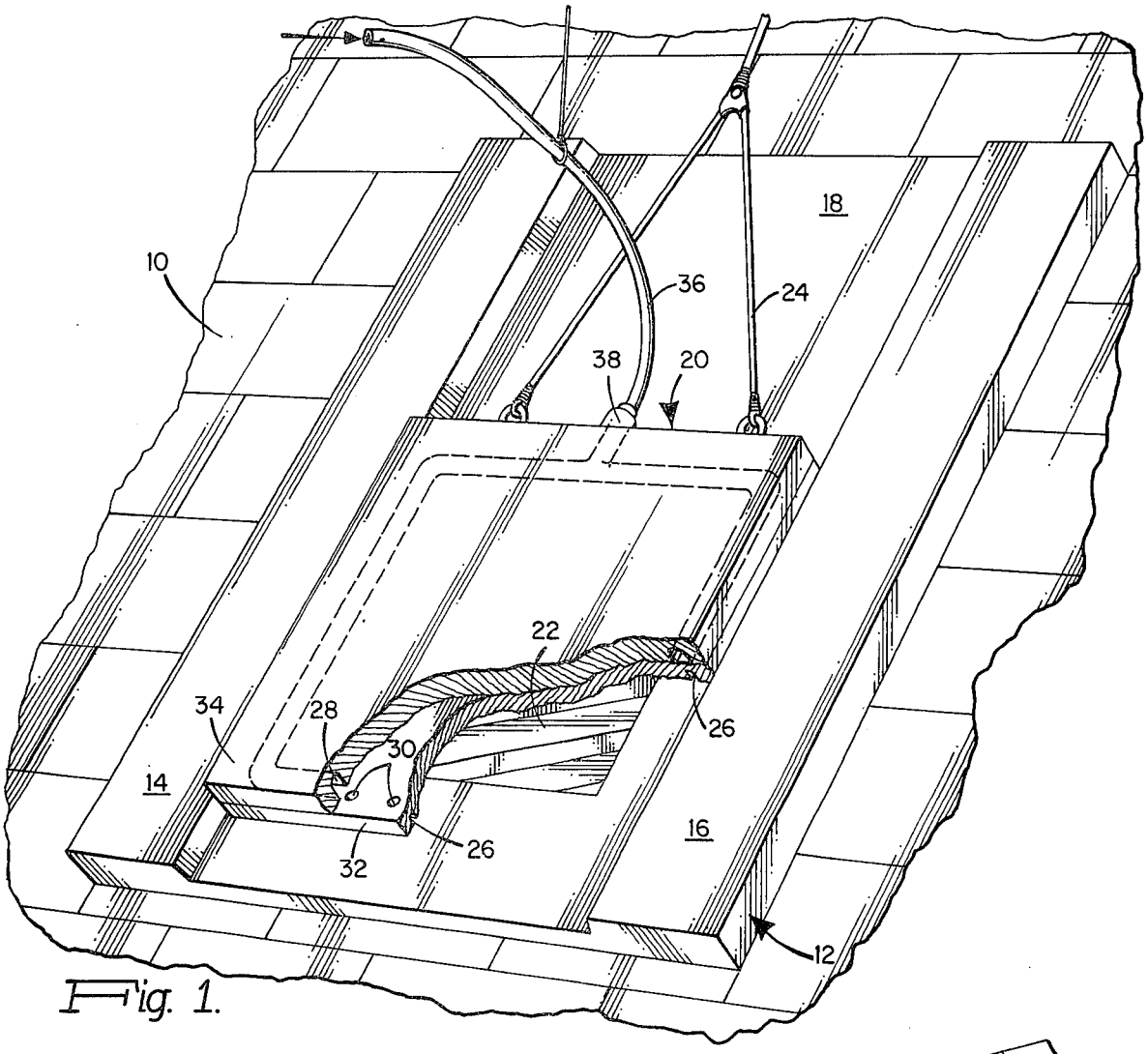
FIG. 1 is a partially cut-away pictorial view of a furnace door seal according to the invention.
Figure 2:
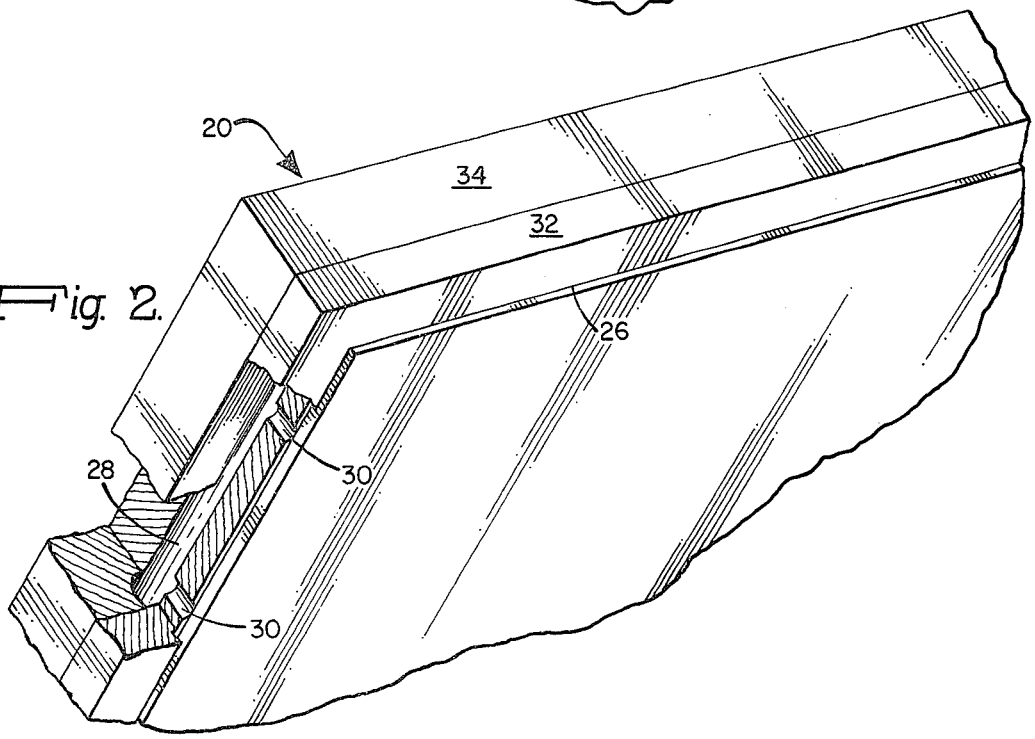
FIG. 2 is a cut-away sectionalized pictorial view of a portion of the embodiment of FIG. 1.

Referring to FIG. 1, there is shown a sliding door for a high temperature furnace which according to the invention embodies a seal which substantially prevents leakage of gas from or into the furnace interior. A portion of a high temperature furnace is shown in FIG. 1 having an inclined end wall 10 composed of fire brick or other refractory material which encloses the furnace chamber. An end plate 12 is provided on the end wall 10 and includes raised side portions 14 and 16 defining a channel 18 therebetween which extends downwardly along the end wall. A generally rectangular door 20 is disposed for slidable movement within channel 18, the door being movable between a closed position covering the opening of furnace chamber 22 and an opened raised position at which a product or material can be loaded or unloaded from the furnace. A cable 24 is affixed to the door and is coupled to a suitable mechanism (not shown) of any well-known form for raising and lowering the door between its closed and opened positions. The inclined disposition of the end wall permits the door 20 to be retained in gravity contact with the confronting surface of channel 18.

A channel or groove 26 is provided in the surface of door 20 confronting channel 18 of the furnace wall and defining a gas orifice around the periphery of the door surrounding furnace chamber 22. A gas supply passage 28 is provided in door 20 and communicates with channel 26 by way of a plurality of ports 30. The door 20 can be constructed in any convenient manner; in the illustrated embodiment the door is composed of a first plate 32 having a channel 26 and ports 30 provided therein, and a cooperative second plate 34 containing supply passage 28. The supply passage 28 is coupled to a source of sealing gas by a flexible tube 36 and coupling 38, the tube 36 being capable of flexing to permit raising and lowering of door 20.

The confronting surfaces of channel 18 and door 20 are machined or otherwise finished to an intended surface smoothness to provide predetermined intimate contact between the mating surfaces of the door and furnace wall. Sealing gas is introduced via tube 36 into passage 28, from which gas flows through ports 30 into channel 26 and thence via the orifice provided by channel 26 between the mating surfaces to the furnace exterior and to the furnace chamber. A gas barrier is provided by the sealing gas flowing between the mating surfaces of the door and furnace wall to isolate the furnace gas within chamber 22 from leakage via the door. The velocity of the sealing gas is sufficiently low to prevent aspiration of furnace gas from within the chamber as the sealing gas flows between the confronting surfaces of the door and furnace wall.

The door 20 is typically fabricated of steel, cast iron or graphite, as is the confronting end plate 12 of the furnace. The sealing gas is neutral and non-reactive with the gas contained within the furnace chamber and preferrably non-toxic and noncombustible. Nitrogen can be typically employed. The sealing gas is provided at a pressure sufficient to overcome the roughness of the confronting surfaces of door 20 and furnace end plate 12 but less than a pressure sufficient to lift the door off of its mounting surface. The pressure of the supplied sealing gas is determined in accordance with the size of the gas orifice and the weight of the door to establish a gas curtain between the door and the confronting furnace surface to provide a barrier which substantially seals the gas within the furnace chamber against leakage via the door.

It will be appreciated that the invention is not limited to the particular embodiment shown and described. For example, the sealing gas can be variously introduced between the confronting surfaces of the furnace wall and movable door. Gas can be introduced by an array of openings rather than the single orifice shown. Moreover, the sealing gas orifice can be in either or both of the confronting surfaces of the door and furnace wall. The invention is not limited to use in only the furnace configuration shown but is broadly useful in a wide variety of environmental chambers in which a movable door is employed. Accordingly, the invention is not to be limited except as indicated in the appended claims.

What is claimed is:

1. For use in a furnace having a chamber in which a predetermined gas environment is to be maintained, a door by which the chamber is accessible and having a surface for mating with a surface of said furnace, a door seal comprising:

a gas orifice provided in at least one of said mating surfaces;

a gas supply path in fluid coupling relationship with said orifice; and means for introducing sealing gas to said gas supply path to cause flow of sealing gas from said orifice between said mating surfaces thereby to prevent leakage of the gas contained within said furnace chamber and leakage of air into the chamber.

2. The invention of claim 1 wherein said gas orifice is provided in the surface of said door confronting a wall of said furnace;

and wherein said gas supply path is provided in said door.

3. The invention of claim 2 wherein said means includes a gas supply tube for flexibly coupling said gas supply path in said door to a source of sealing gas.

4. The invention according to claim 3 wherein said door is slidably disposed on an end wall of said furnace for movement between an opened and a closed position.

5. The invention of claim 4 wherein said furnace end wall is downwardly and outwardly inclined such that said slidably disposed door is maintained in contact with the confronting surface of said end wall by gravity.

6. A high temperature furnace comprising:

a housing defining a furnace chamber adapted to contain a predetermined gas environment and including an end wall having an opening into said chamber;

a door disposed for movement between a closed position sealing said chamber and an opened position for access to said chamber;

a gas orifice provided in the surface of said door confronting a surface of said end wall;

a gas supply path in said door in fluid coupling relationship with said orifice; and means for introducing sealing gas into said gas supply path to cause the flow of sealing gas from said orifice between the confronting surfaces of said door and end wall to the furnace exterior and furnace chamber thereby to establish a sealing gas barrier to substantially prevent leakage of gas contained within said furnace chamber and leakage of air into the chamber.

7. For use in apparatus having an environmental chamber in which a predetermined gas environment is to be maintained, a door by which the chamber is accessible and having a surface for mating with a surface of said apparatus, a door seal comprising:

a gas orifice provided in at least one of said mating surfaces;

a gas supply path in fluid coupling relationship with said orifice, and means for introducing sealing gas to said gas supply path to cause flow of sealing gas from said orifice between said mating surfaces thereby to prevent leakage of the gas contained within said chamber and leakage of air into the chamber.

* * * * *